US009242449B2

(12) United States Patent
Hauck et al.

(10) Patent No.: US 9,242,449 B2
(45) Date of Patent: Jan. 26, 2016

(54) OFFSET PRINTING METHOD

(71) Applicant: HEIDELBERGER DRUCKMASCHINEN AG, Heidelberg (DE)

(72) Inventors: Axel Hauck, Karlsruhe (DE); Bernhard Buck, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 372 days.

(21) Appl. No.: 13/872,290

(22) Filed: Apr. 29, 2013

(65) Prior Publication Data

US 2013/0312629 A1 Nov. 28, 2013

(30) Foreign Application Priority Data

Apr. 30, 2012 (DE) ..... 10 2012 008 666

(51) Int. Cl.

| | |
|---|---|
| ***B41M 1/06*** | (2006.01) |
| ***B41M 1/18*** | (2006.01) |
| ***B41F 7/02*** | (2006.01) |
| ***B41F 13/193*** | (2006.01) |
| ***B41F 33/00*** | (2006.01) |

(52) U.S. Cl.

CPC ..... *B41F 13/193* (2013.01); *B41F 33/00* (2013.01); *B41M 1/06* (2013.01)

(58) Field of Classification Search

CPC ..... B41F 13/12; B41F 13/193; B41F 13/50; B41F 13/0008; B41F 13/004; B41F 33/00; B41F 33/0009; B41F 33/08; B41F 33/16; B41M 1/06; B41M 1/18; B41P 2233/11; B41P 2213/11; B41P 2213/73; B41P 2213/734; B41P 2213/90

USPC ..... 101/492, 484, 481, 485, 486

See application file for complete search history.

(56) References Cited

U.S. PATENT DOCUMENTS

| | | | | |
|---|---|---|---|---|
| 5,365,847 | A | 11/1994 | Pers | |
| 8,813,647 | B2 * | 8/2014 | Hauck et al. | 101/484 |
| 2003/0217662 | A1 * | 11/2003 | Koifman et al. | 101/484 |

FOREIGN PATENT DOCUMENTS

| | | | |
|---|---|---|---|
| DE | 44 13 735 | A1 | 10/1995 |
| DE | 102 46 072 | A1 | 5/2003 |

OTHER PUBLICATIONS

German Patent and Trademark Office Seardh Report Dated Dec. 4, 2012.

* cited by examiner

*Primary Examiner* — Leslie J Evanisko

(74) *Attorney, Agent, or Firm* — Laurence A. Greenberg; Werner H. Stemer; Ralph E. Locher

(57) ABSTRACT

An offset printing method includes creating halftone dots corresponding to a printed image and formed of printing ink, on a surface of a transfer cylinder and transferring the halftone dots to a printing substrate while the transfer cylinder rotates about its longitudinal axis. A halftone value in a printed image on the printing substrate is adjusted to a desired value by modifying a halftone dot size. The offset printing method improves the quality of the printed image by increasing the halftone dot size by a desired amount by providing a relative offset between a device that creates the halftone dots and the surface of the transfer cylinder.

9 Claims, 2 Drawing Sheets

OFFSET PRINTING METHOD

CROSS-REFERENCE TO RELATED APPLICATION

This application claims the priority, under 35 U.S.C. §119, of German Patent Application DE 10 2012 008 666.0, filed Apr. 30, 2012; the prior application is herewith incorporated by reference in its entirety.

BACKGROUND OF THE INVENTION

Field of the Invention

The invention relates to an offset printing method which includes creating halftone dots of printing ink on a surface of a transfer cylinder, corresponding to an image to be printed, transferring the halftone dots during a revolution of the transfer cylinder about its longitudinal axis onto a printing substrate, and adjusting a tone value to attain a desired value in a printed image on the printing substrate by modifying a halftone dot size.

The quality of printed images created in a lithographic offset printing process mainly depends on the thickness of the ink layer and the halftone dot size of the color separations that have been printed on top of each other. When ink is applied to the printing areas, the thickness of the ink layer is controlled or regulated by ink metering elements. German Patent Application DE 44 13 735 A1 discloses controlling halftone dot sizes during printing by adjusting the cylinder pressure of the cylinders involved in the printing process and, if necessary, additionally by varying the temperature of the printing ink and/or of the dampening solution, the amount of dampening solution, or the proportion of dampening solution additives. The shape and size of the halftone dots has an influence on the tonal value and the representation of colors in the printed image.

During printing, a printing substrate is conveyed through the printing press by drums and cylinders. In conventional lithographic offset printing presses, the printing forme cylinders, transfer cylinders, and impression cylinders are driven by a gear train. Since the cylinders that transfer ink do not roll on each other in an optimum way, slurring or shifting and ghosting may occur in the printed image, which become manifest in halftone dot deformation in the printing direction and in a direction perpendicular thereto. Undesired halftone dot deformations may be reduced if the elements that guide the printing substrate and transfer the ink have a sufficient degree of stiffness. Furthermore, active vibration damping measures may be taken to reduce slurring or ghosting. In machines that have individual drives for different cylinders, the correct rotation of cylinders relative to each other may be monitored and controlled using measuring technology. In a printing process described in German Patent Application DE 102 46 072 A1, the printing forme cylinders of a lithographic offset printing press are driven by individual drives. By controlling the motors, it is possible to periodically operate the printing forme cylinders at a differential speed relative to the neighboring transfer cylinders during a revolution to control the print repeat length.

SUMMARY OF THE INVENTION

It is accordingly an object of the invention to provide a lithographic offset printing method which overcomes the hereinafore-mentioned disadvantages of the heretofore-known methods of this general type and which results in an improved printing quality.

With the foregoing and other objects in view there is provided, in accordance with the invention, an offset printing method which comprises creating halftone dots of printing ink on a surface of a transfer cylinder, corresponding to an image to be printed, transferring the halftone dots during a revolution of the transfer cylinder about its longitudinal axis onto a printing substrate, adjusting a tone value to attain a desired value in a printed image on the printing substrate by modifying a halftone dot size, and increasing a halftone dot size by a desired amount by providing a relative offset between a device creating the halftone dots and a surface of the transfer cylinder.

In accordance with the invention, the halftone dot size in the printed image is controlled or regulated by specifically generating a relative offset between a device that creates the halftone dots and the surface of a transfer cylinder. If the halftone dots are created by applying ink to a printing forme on a printing forme cylinder, the relative offset is generated between the surfaces of the printing forme and of the transfer cylinder, with the printing forme cylinder preferably being driven by a separate drive. The process may also be implemented in lithographic offset presses in which the halftone dots are digitally created on a printing forme cylinder. For example, the halftone dots may be created on the surface of a printing forme cylinder by an inkjet device.

When printing a color separation in a printing unit, the method allows the dot gain to be set or adjusted before or during printing. Through the use of a targeted increase of the halftone dot size, the coloration in the halftone may be adjusted independently of the coloration of the fulltone. The application of the method provides a further degree of freedom to influence the representation of colors in the printed image in addition to controlling the thickness of the ink layer.

In offset printing presses that include drives directly driving the printing forme cylinders, the angular positions of the printing forme cylinders relative to the angular positions of the respective associated transfer cylinders are controlled in such a way that for each revolution, an in-register transfer of the printed image from the printing forme to the surface of the respective transfer cylinder is achieved. In accordance with the invention, a relative offset between the surfaces of the printing forme cylinders and the associated transfer cylinders intentionally creates a ghosting effect to achieve a dot gain in the halftone. This has virtually no influence on the fulltone in the printed image. An offset in the circumferential or printing direction from revolution to revolution between printing forme cylinders and transfer cylinders of identical diameter is preferably to be periodic to ensure that the ghosting shadow about a halftone dot will always be of equal magnitude and changes sides relative to the nominal position of the halftone dot. During the production run, the result will be a uniformly increased tone value in the printed image. For example, if a 10 μm offset is created between the surfaces in the midrange tone at a halftone value of 40% and 60 lines per centimeter and a dot diameter of 120 μm, the result is a dot gain of approximately 3%.

The relative rotation of cylinders that have a gap by the offset value in the circumferential direction is preferably implemented when the gaps are opposite each other. This means that the entire printed image is transferred in an offset condition, i.e. the dot gain is identical over the entire printing format.

If the dot gain in the printed image varies across the length of the print, for example if, in sheet-fed printing, the dot gain in the region of the trailing sheet edge is greater than the dot gain in the region of the leading sheet edge, an adjustment may be made to achieve different dot gains at the trailing sheet edge and at the leading sheet edge.

In accordance with the method, a defined dot gain is achieved. The printing formes or printing plates used for printing are created with reduced halftone values. Due to the halftone dot enlargements that are effected in a predefined way, the halftone value attains a desired nominal value.

In order to implement the method, the shape of the halftone dots on the printing forme may be different from a circular shape. For example, if circular halftone dots are desired in the printed image, the halftone dots on the printing forme may be elliptical in a direction transverse to the printing direction. Due to the halftone dot enlargements that are specifically brought about, approximately circular halftone dots are created in the printed image as a result of the ghosting shadows.

Other features which are considered as characteristic for the invention are set forth in the appended claims.

Although the invention is illustrated and described herein as embodied in an offset printing method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
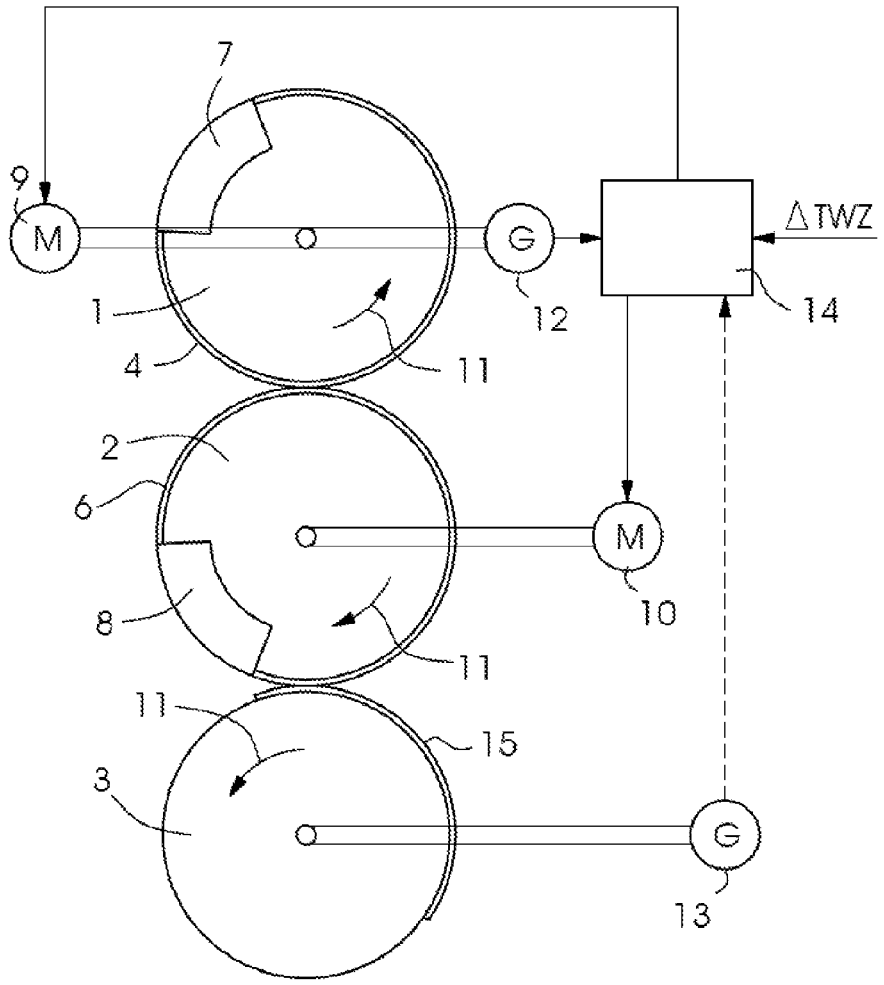
FIG. 1 is a diagrammatic, end-elevational view of a portion of a printing unit of a four-color lithographic offset printing press.
Figure 3A:
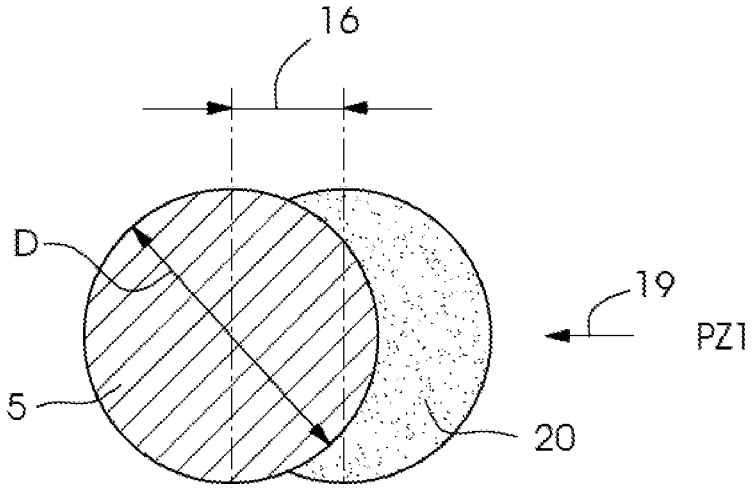
FIGS. 3A, 3B and 3C are diagrams showing a halftone dot enlargement.
Figure 3B:
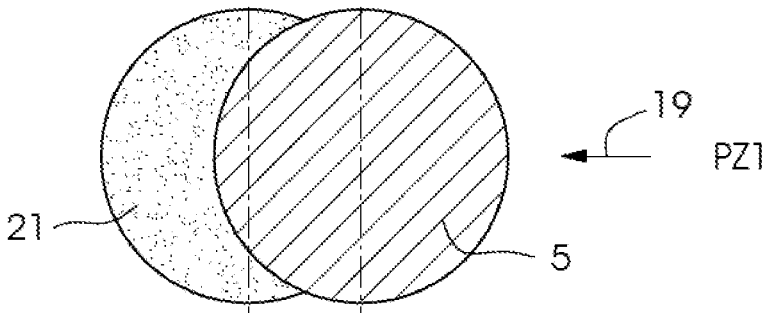
Figure 3C:
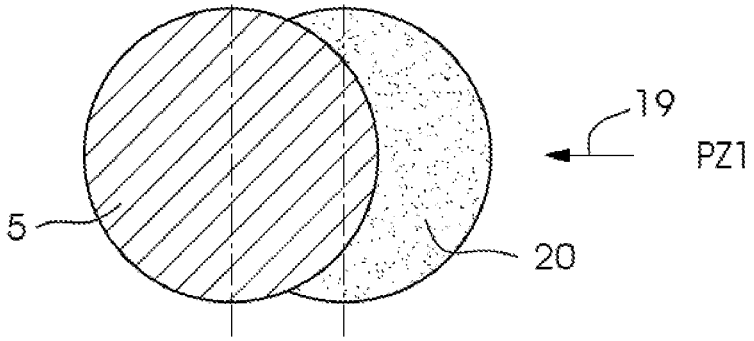

Referring now to the figures of the drawings in detail and first, particularly, to FIG. 1 thereof, there is seen a plate cylinder 1, a transfer cylinder 2 and an impression cylinder 3 in a printing unit of a lithographic offset printing press. The plate cylinder 1 carries an imaged printing forme 4 that has ink-accepting halftone dots 5 (FIGS. 3A, 3B and 3C). As is shown in FIGS. 3A, 3B and 3C, the halftone dots 5 are circular. The printing forme 4 may be considered a device for creating the halftone dots. The method of the invention may be implemented with any halftone dot shape. The transfer cylinder 2 carries a blanket 6. Each of the cylinders 1, 2 have a respective gap 7, 8 containing clamping devices for the printing forme 4 and the blanket 6. All of the cylinders 1 to 3 have an identical diameter and are in rolling contact with the respective adjacent cylinder 1 to 3 during printing. The plate cylinder 1 is directly driven by an electric motor 9. The transfer cylinder 2 and the impression cylinder 3 are driven by a main drive motor 10 through a gear train. During printing, the cylinders 1 to 3 rotate about their axes in the direction of arrows 11. The motors 9, 10 and rotary encoders 12, 13 that register the rotary position of the cylinders 1, 2 are connected to a control unit 14.

During printing, an inking unit applies ink to the halftone dots 5. Due to an ink splitting effect, the printing ink on the halftone dots 5 is transferred to the surface of the blanket 6. When a sheet 15 passes a nip between the transfer cylinder 2 and the impression cylinder 3 under pressure, the printing ink on the halftone dots 5 is transferred to the surface of the sheet 15 due to the ink splitting effect. A color separation image is created on the surface of the sheet 15. For four-color printing, four printing units are provided, each including a plate cylinder 1 that is driven independently of the associated transfer cylinder 2 and/or impression cylinder 3.

The method of the invention may be implemented in the configuration described above, as follows:

When the printing forme 4 is created in an exposure device, the halftone dots 5 are created to have a diameter D which results in a halftone value on the printing forme 4 that is lower than the value that is desired in the color separation on the sheet 15. A dot gain ΔTWZ that would be required to attain the desired halftone value on the sheet 15 is input into the control unit 14 by an input device.

Figure 2:
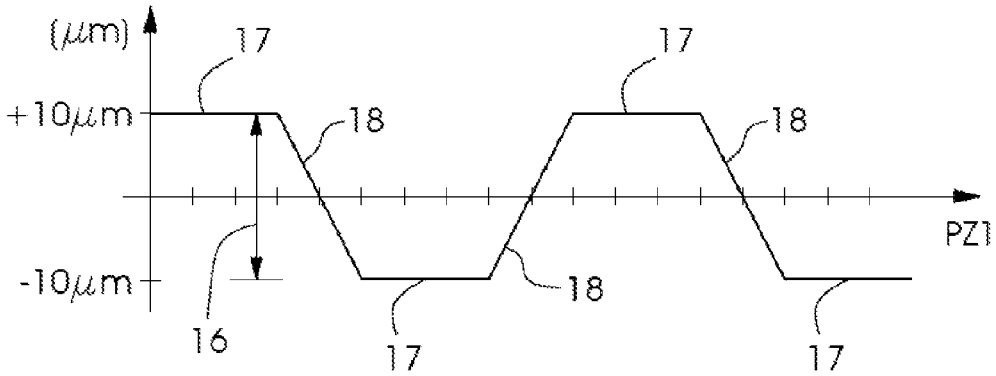
FIG. 2 is a diagram showing a relative offset between a plate cylinder and a transfer cylinder.

A dot gain is achieved by setting a relative offset 16 between the surfaces of the printing forme 4 and of the blanket 6 for each revolution of the cylinders 1 to 3 by using the motor 9. The relative offset is created or set by an axial displacement of one of the printing forme cylinder 1 or the transfer cylinder 2. The diagram of FIG. 2 indicates that the relative offset 16 between the cylinders 1, 2 is set when the gaps 7, 8 are opposite each other. In the illustrated example, the relative offset 16 is ±10 μm. In respective angular ranges 17 in which the surfaces of the printing forme 4 and of the blanket 6 roll on each other, the offset 16 remains constant at +10 μm or −10 μm. In angular ranges 18, in which the gaps 7, 8 are opposite each other, the offset 16 is adjusted from +10 μm to −10 μm and from −10 μm to +10 μm, respectively. For this purpose, the motor 9 is actuated by the control unit 14 in such a way that the plate cylinder 1 slightly leads or trails relative to the transfer cylinder 2. In the control unit 14, the signals of the rotary encoder 12, 13 are continuously being processed to generate actuating signals for the motor 9.

FIGS. 3A to 3C illustrate the dot gain of a halftone dot 5 caused by the offset 16. The halftone dot 5 shown in FIG. 3A has been enlarged by a ghosting shadow 20, which is behind the halftone dot 5 as viewed in the printing direction 19. As is shown in FIG. 3B, when the offset 16 is reset in the aforementioned gap region 18, the halftone dot is offset by 20 μm in the printing direction 19 relative to the position of the halftone dot 5 in the previous revolution of the plate cylinder 1. The halftone dot 5 is enlarged due to its ghosting shadow 21, which is in front of the halftone dot 5 as viewed in the printing direction 19. FIG. 3C illustrates a situation in which the offset 16 has again been reset by 20 μm in a gap region 18. The result is that the halftone dot 5 is enlarged by a ghosting shadow 20 as described with reference to FIG. 3A.

The ghosting shadows 20, 21 are the result of residual ink from the halftone dots 5 on the blanket 6 from the previous revolution of the transfer cylinder 2. The offset 16 is reset after every revolution of the cylinders 1, 2 so that the enlargement of the halftone dots 5 remains and corresponds to the desired dot gain that was input in the control unit 14 as a nominal value Δ TWZ.

The invention claimed is:

1. An offset printing method comprising the following steps:

using a device to create halftone dots of printing ink on a surface of a transfer cylinder corresponding to an image to be printed, each halftone dot having a diameter and being sized smaller than a desired halftone dot size for a printed image;

determining a required amount of dot gain needed to obtain the desired halftone dot size for the printed image on a printing substrate and inputting the dot gain amount into a control unit;

transferring the halftone dots of printing ink during an initial revolution of the transfer cylinder about its longitudinal axis onto the printing substrate leaving a residual amount of ink as a ghosting shadow on the transfer cylinder;

using the control unit to increase the size of the halftone dots on a surface of the transfer cylinder during a subsequent revolution of the transfer cylinder to the desired halftone dot size by setting a relative offset between the device creating the halftone dots and the surface of the transfer cylinder and using the ghosting shadow to enlarge the halftone dots by the required amount of dot gain; and transferring the enlarged halftone dots to a subsequent printing substrate to create the printed image.

2. The method according to claim 1, wherein:

the device creating the halftone dots on the surface of the transfer cylinder includes an inked printing forme on a surface of a printing forme cylinder in a lithographic offset printing press; and the step of setting a relative offset between the device creating the halftone dots and the surface of the transfer cylinder includes moving surfaces of the printing forme and of the transfer cylinder relative to each other during one revolution of the transfer cylinder.

3. The method according to claim 2, which further comprises:

driving the printing forme cylinder to rotate by a separate drive independently of a drive of the transfer cylinder and of an impression cylinder.

4. The method according to claim 2, which further comprises:

providing each of the printing forme cylinder and the transfer cylinder with a respective gap in the surface of the cylinder; and the step of setting the relative offset occurs during each revolution of the cylinders when the gaps are opposite each other.

5. The method according to claim 4, which further comprises:

periodically repeating the setting of the relative offset after an integer number of revolutions of the printing forme cylinder.

6. The method according to claim 2, wherein:

the step of setting the relative offset further includes axially displacing one of the printing forme cylinder or the transfer cylinder.

7. The method according to claim 1, wherein:

the device creating the halftone dots on the surface of the transfer cylinder includes an inked printing forme on a surface of a printing forme cylinder in a lithographic offset printing press; and the step of setting the relative offset further includes axially displacing one of the printing forme cylinder or the transfer cylinder.

8. The method according to claim 1, which further comprises:

increasing the halftone dot size to vary across a length of the printing substrate in the form of a sheet.

9. The method according to claim 1, which further comprises:

changing a direction of the relative offset after each revolution of the transfer cylinder while an amount of the relative offset remains constant.

* * * * *